United States Patent [19]

Smith

[11] 4,444,153

[45] Apr. 24, 1984

[54] GRATELESS FURNACE FOR SOLID FUEL

[75] Inventor: Trevor D. Smith, Abergavenny, England

[73] Assignee: Suxe Combustion Limited, Abergavenny, England

[21] Appl. No.: 293,475

[22] Filed: Aug. 17, 1981

[51] Int. Cl.[3] ..... F22B 33/00; F23B 7/00

[52] U.S. Cl. ..... 122/2; 122/15; 110/234; 110/254

[58] Field of Search ..... 110/235, 234, 233, 248, 110/238, 254; 122/15, 2

[56] References Cited

U.S. PATENT DOCUMENTS

| | | | |
|---|---|---|---|
| 2,642,019 | 6/1953 | Cushing et al. | 110/234 |
| 3,482,533 | 12/1969 | Ankerson | 110/234 |
| 3,785,304 | 1/1974 | Stookey | 110/234 |
| 4,050,387 | 9/1977 | Luchsinger et al. | 122/2 |
| 4,102,279 | 7/1978 | Gröschl et al. | 110/254 |
| 4,206,723 | 6/1980 | Kunkel | 122/2 |

FOREIGN PATENT DOCUMENTS

| | | |
|---|---|---|
| 323219 | 12/1929 | United Kingdom . |
| 659882 | 10/1951 | United Kingdom . |
| 749682 | 5/1956 | United Kingdom . |
| 840669 | 7/1960 | United Kingdom . |
| 886745 | 1/1962 | United Kingdom . |

*Primary Examiner*—Henry C. Yuen

*Attorney, Agent, or Firm*—Parmelee, Miller, Welsh & Kratz

[57] ABSTRACT

A grateless furnace has a combustion chamber, means to introduce solid fuel into the combustion chamber and to permit said fuel to form a fire bed in the bottom thereof, the combustion chamber being of such configuration that slag formed during combustion of the fuel accumulates under the influence of gravity, at a low part of the bottom of the combustion chamber, said low part having an opening through which said slag may pass for removal from the furnace. The bottom of the chamber may be V-shaped.

6 Claims, 4 Drawing Figures

GRATELESS FURNACE FOR SOLID FUEL

BACKGROUND OF THE INVENTION

Field of the Invention

This invention relates to a grateless furnace of the type, hereinafter referred to as of the type described, having a combustion chamber in the bottom of which solid fuel forms a bed (herein referred to as a fire bed) in which, in use, combustion takes place, the furnace including means to direct air (herein referred to as primary air) through the bed to assist in combustion.

One example of such a furnace is described in detail in U.K. patent specification No 641024.

Grateless furnaces of the type described have the advantage that the temperature of fine fuel particles and ashes which accumulate at the bottom of the fire bed is maintained sufficiently high to permit of combustion of the fuel particles and to cause the ashes to melt or fuse to form slag.

However, in known furnaces of the type described it has been necessary to frequently rake out the slag and other non-combustibles (hereinafter referred to as slag) so that they do not reduce the efficiency of the furnace and to make space in the combustion chamber for new fuel to be introduced.

It is an object of the present invention to provide a new or improved grateless furnace of the type described which overcomes or reduces this problem.

SUMMARY OF THE INVENTION

According to the invention we provide a grateless furnace of the type described comprising means to introduce solid fuel into the combustion chamber and to permit said fuel to form a fire bed in the bottom thereof, the combustion chamber being of such configuration that slag formed during combustion of the fuel accumulates under the influence of gravity, at a low part of the bottom of the combustion chamber, said low part having an opening through which said slag may pass for removal from the furnace.

The bottom of the furnace may have at least one side part inclined to the horizontal, the opening being provided at or adjacent the lowest part of the inclined part.

Preferably, the furnace is of elongate substantially cylindrical configuration, the bottom of the combustion chamber having two inclined parts in a V configuration along the length of the combustion chamber, the opening being provided along the apex of the V.

It will be appreciated that as the solid fuel is continuously being burned, new fuel introduced and slag removed from the fire bed via the opening, that burnt fuel and other non-combustibles will move under the influence of gravity, towards the apex of the V configuration of the bottom of the combustion chamber and be converted into slag, which in turn, will pass through the opening and thus be removed from the furnace. The slag may be collected on a water coated clinker tray, or on a conveyor or in a container positioned beneath the opening, and thereafter be disposed of.

It has been found that a grateless furnace in accordance with the invention permits of smokeless burning of most fuels, including household screenings, coking coals and lignites which other furnaces have not been able to burn smokelessly.

The chosen angle of inclination of the side part or parts will depend upon the following.

First, the rated output of the furnace and the physical size of the combustion chamber will affect the rate at which fuel needs to be introduced into and removed from the furnace. Obviously the steeper the inclination of the side part or parts, to the horizontal, the faster the rate at which slag will be removed. If the side part or parts are too steep, unburnt fuel and other non-combustibles not converted into slag, will be removed, which is obviously undesirable and wasteful.

Secondly, the size of the solid fuel particles will affect the rate at which they fall under gravity towards the bottom of the combustion chamber.

Taking these points into consideration, it has been found that inclining the side part or parts at an angle of between 30° and 50°, but preferably about 40°, to the horizontal has been particularly effective. Where the bottom of the combustion chamber is of V-configuration, an included V angle of about 100° is preferable.

The opening through which the slag may pass may extend substantially along the whole length of the combustion chamber but if desired the opening may extend along part of the length only.

In a preferred embodiment a further supply of air (herein referred to as secondary air) is supplied to the combustion chamber above the level of the fire bed to enhance combustion in the fire bed. The secondary air may be preheated by for example, introducing the air into a hollow provided in a part of the wall of the furnace such as a door.

At least part of the combustion chamber is water cooled. In particular, the inclined side part or parts of the combustion chamber are water cooled to ensure that slag produced during combustion does not adhere thereto.

If desired, the means which introduce fuel into the furnace and the means which direct primary air through the fire bed may extend through said jacket and thus be cooled.

The remainder of the furnace not water cooled being lined with refractory material.

The inclined side part or parts of the bottom of the combustion chamber may have a plurality of apertures therein through which at least part of said primary air may be passed. The apertures may have nozzles secured therein and the nozzles may extend through the water jacket, or be air cooled.

The primary air may be fed to the nozzles, from an air reservoir, to which air is fed under pressure by a fan.

The furnace may be a pre-burner adapted to be used in conjunction with a boiler which itself has a combustion chamber, although a furnace in accordance with the invention may be the furnace of a boiler itself.

Where the furnace is a pre-burner, the combustion chamber may have an exhaust opening at one end thereof through which the flame, hot gases and other combustion products (herein referrred to as flame and hot gases) may pass into the boiler.

Further, the furnace may be provided with a nozzle at the exhaust opening of the combustion chamber to enhance the transfer of hot gases and burning fuel into the boiler.

Solid fuel for use in the furnace may be stored in a hopper above the furnace, the fuel resting on a guide to ensure an even flow of fuel from the hopper over the entire length of the combustion chamber. Preferably the guide is of inverted V-configuration to permit the fuel to be fed to both sides of the combustion chamber simultaneously.

Gate valves or other means may be provided to regulate the flow of fuel to the furnace and/or to shut off the flow of fuel altogether if required. The gate valves may be controlled manually, electonically, or by any other means.

Preferably the fuel is fed into the combustion chamber from the hopper, through one or more channels, the or each of which communicate with the combustion chamber. The channels may extend through the water jacket.

BRIEF DESCRIPTION OF THE DRAWINGS

The invention will now be described with the aid of the accompanying drawings in which:

FIG. 3 is a side elevation of a furnace/boiler combination, the furnace of which may be modified to embody the invention;

FIG. 4 is a side elevation of an alternative furnace/-boiler combination, the furnace of which may be modified to embody the invention.

DESCRIPTION OF THE PREFERRED EMBODIMENTS

Figure 1:
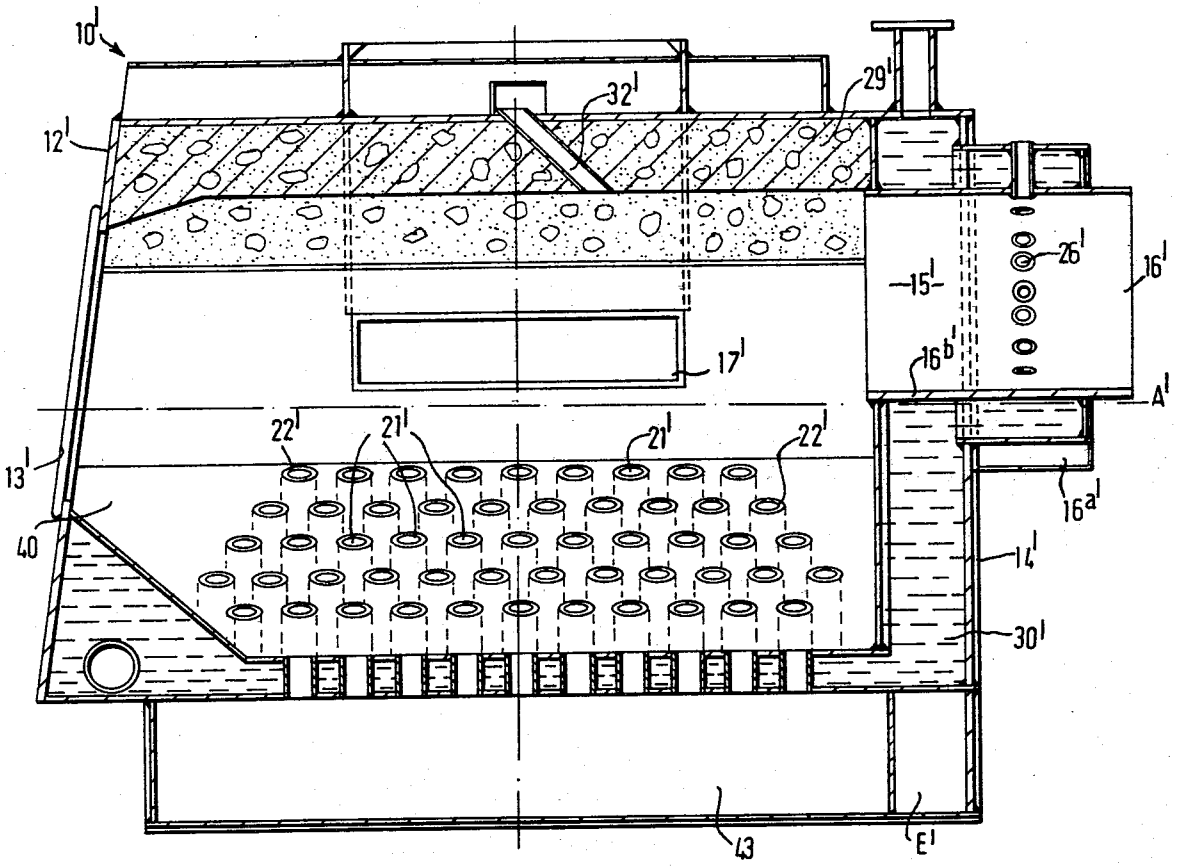
FIG. 1 is a sectional side view of a furnace according to the invention.
Figure 2:
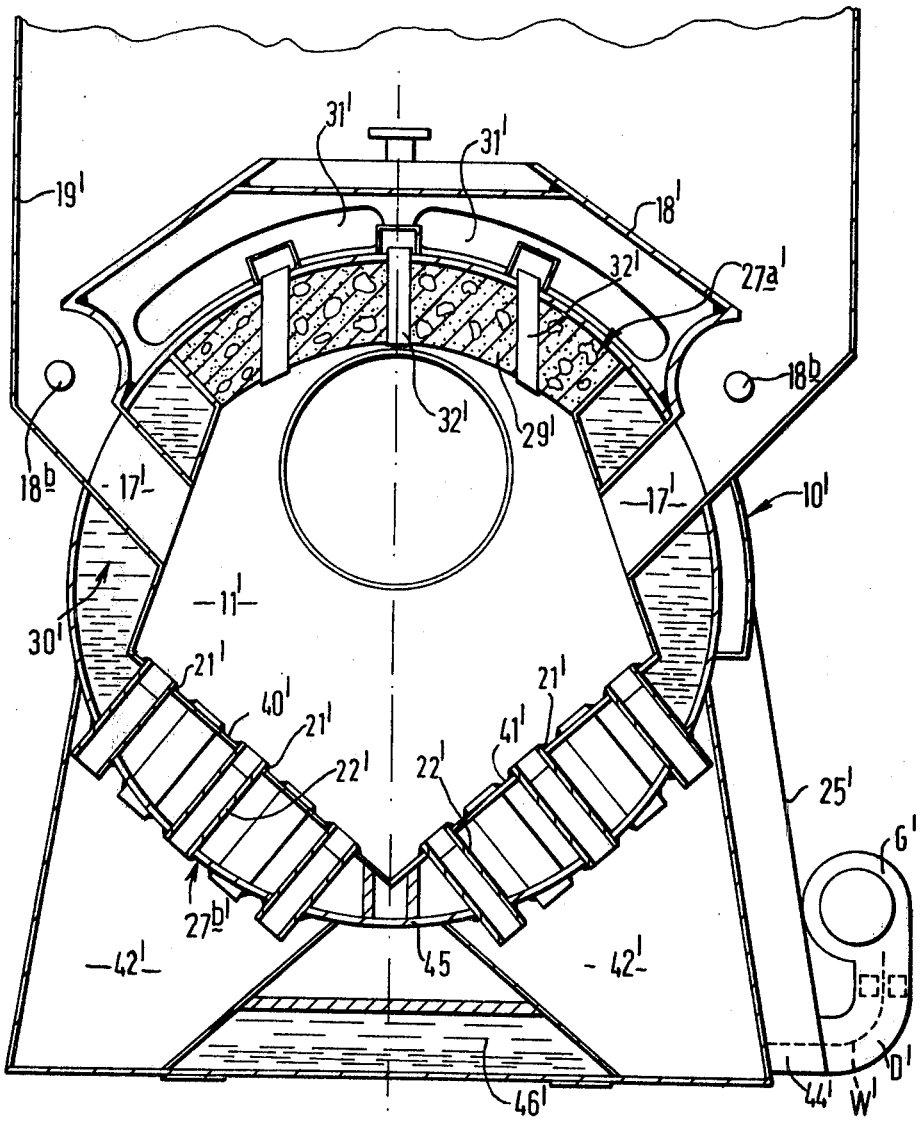
FIG. 2 is a section on the line II—II of the furnace of FIG. 1, with a hopper located above the furnace.

Referring to FIGS. 1 and 2 of the drawings there is shown a furnace which embodies the invention, intended for use as a pre-burner in conjunction with a boiler (not shown).

The furnace 10' is not entirely water cooled.

The furnace 10' is of the grateless type comprising an elongate, substantially cylindrical combustion chamber 11' having a central axis A'. At the forward end 12', a slag door 13' is provided to permit access to the interior of the furnace 10' for maintenance purposes. At the rear end 14' of the combustion chamber 11', an exhaust opening 15' is provided whereby hot gases may pass from the furnace 10' into the boiler and be used, for example to heat water. A nozzle 16' which is adapted to extend into a heating chamber of the boiler, is located in the opening 15' and is partially water cooled and partially cooled by tertiary air as described below. The spent gases are passed from the boiler to a flue (not shown).

Two channels 17' are provided which extend from the exterior of the furnace into the combustion chamber 11'. Solid fuel may pass from a hopper 19' located above the furnace (only shown in FIG. 2) via an inverted channel-shaped guide 18' through the channels 17' into the combustion chamber 11', the flow being regulated by gate valves (not shown) rotatable about pivots **18*b*** which may be controlled manually via handles (not shown) or automatically by solenoids actuated by pressure or temperature thermostats of the furnace or boiler and/or an electronic control circuit which may be programmed to control the furnace to provide a predetermined output for a predetermined time.

The solid fuel falls downwardly towards the bottom of the combustion chamber 11' and forms a bed of fuel which, when combusted, provides a fire bed.

The channels 17' are each located either side of and equidistant from a vertical plane V' and just above a horizontal plane containing axis A'.

The bottom of the combustion chamber 11' is of V configuration and the sides 40', 41' of the V each have a plurality of apertures 21' in which tubes 22' comprising nozzles which extend generally downwards to air reservoirs 42', 43', are welded. The reservoir 42' has an inlet 44'which communicates with a duct D' to which air is fed from a fan G'. The duct D' has a dividing wall W' therein whereby the air from the fan G' is divided into primary and secondary supplies, the primary supply passing to inlet 44' and thus into reservoir 42', and the secondary supply is passed into a further duct 25'.

Air from the reservoir 42' passes to reservoir 43' by a duct E' at the rear 14' of the furnace 10', and thus air from both reservoirs 42', 43' passes upwardly through the nozzles 22' and through the fire bed on the bottom of the combustion chamber 11', said air comprising a primary air supply which assists in combustion and maintains the entire fire bed at a high temperature.

The further duct 25' extends from the duct D' to spaces 31' in the roof of the furnace 10' wherein the secondary air passes downwardly through apertures 32' into the combustion chamber 11' above the level of the fire bed to further enhance combustion. It will be appreciated that the secondary air supply will be heated in the spaces 31' thereby increasing the efficiency of the furnace.

A still further duct (not shown) directs a proportion of the primary air from the reservoirs 42, 43 to the nozzle 16' at the rear 14' of the furnace 10' to provide a tertiary air supply which is circulated around a hollow **16*a'* of the nozzle 16' whereby the tertiary air is heated and the nozzle 16' cooled. The tertiary air then passes through holes 26' in the nozzle 16' into the opening 15' to create a cyclone to ensure proper mixing of the hot gases and complete combustion of the fuel particles contained therein, as they pass from the furnace 10'** into the boiler.

The combustion chamber 11' is divided into two regions, an upper region **27*a'* and a lower region 27*b'***.

Part of the upper region **27*a'* of the combustion chamber 11', i.e. a region above the channels 17', is lined with a layer of refractory material 29' of the type known as Durax 1600 concrete. Thus this part of the upper region 27*a'*** of the combustion chamber is protected from heat damage.

The lower region **27*b'* of the combustion chamber, i.e. the region extending slightly above and extending below the channel 17', is provided with a water jacket 30' having an inlet (not shown) and an outlet (not shown) to cool the walls of the lower region 27*b'* of the chamber 11'. The primary air supply nozzles 22', the channels 17' and a part 16*b'* of the nozzle 16' in the exhaust opening 15', extend through the water jacket 30'** and are thus cooled thereby.

Thus, this furnace 10' is a hybrid between a water-cooled furnace wherein the entire combustion chamber is enveloped in a water jacket to cool the entire wall surface thereof, and a refractory-lined furnace wherein the entire internal surface of the combustion chamber is lined with refractory material.

A grateless entirely water-cooled preburner furnace has the disadvantages that a proportion of the heat of the furnace which would otherwise be transferred to the boiler is lost to the water jacket, and, as it is usual to interconnect the water space of the boiler containing the water being heated and the water jacket of the furnace to increase the efficiency of the furnace and reduce heat loss, it is difficult to remove the preburner furnace from the boiler for maintenance purposes.

Grateless preburner furnaces which are entirely lined with refractory have the disadvantages that clinker and slag adhere to the refractory, and fuel such as coal abrades the surface as it moves relative thereto thereby damaging the refractory. This is especially important in the present case as the slag and clinker are encouraged to move over the inclined parts 40', 41' to the opening 45'. Further, the nozzles which provide the primary air to the fire bed and the secondary air above the fire bed, become damaged by the heat produced by the furance.

The hybrid furnace described, combines the advantages of both types of known furnace and substantially overcomes the disadvantages of both types of furnace.

At the apex of the V at the bottom of the chamber 11' there is an opening 45' which extends along substantially the entire length of the combustion chamber 11', through which slag produced during combustion of the solid fuel, may pass and be removed from the furnace. Thus as new fuel is fed into the chamber 11' from the hopper 19', burnt fuel and other non-combustibles will move in the fire bed under gravity towards the apex of the V and be converted to slag which will eventually pass through the opening 45 and be removed from the furnace.

A water cooled clinker tray 46' may be placed beneath the opening 45' to facilitate disposal of the slag. However, if desired, a conveyor or container may be placed beneath the opening 45'.

Although the bottom of the combustion chamber 11' has been described as being in a V formation, if desired, any other configuration having a downwardly inclined part to direct the slag and other non-combustibles to an opening in a low part of the combustion chamber may be used. Further, although the opening 45' has been described as extending over substantially the entire length of the combustion chamber 11', if desired, the opening 45' may extend over part or parts of the length of the combustion chamber 11' only.

Although in the furnaces 10' described above, the extent to which the combustion chamber is refractory lined has been described as comprising the region or part of the region between the channels 17' a greater or lesser region may be refractory lined, as desired.

The means for supplying solid fuel to the combustion chambers 11 or 11' has been described as comprising a hopper 19 or 19' but it will be appreciated that any other means may be employed, although the means described provide the advantage that an even flow of fuel is provided to both sides of the furnace 10' along the entire length thereof.

Further, in each embodiment described above, the furnace 10, 10' has been described as being cylindrical but if desired, furnaces of another suitable shape may embody the invention. Further, although a pre-burner furnace has been described, a boiler may embody the invention.

Figure 3:
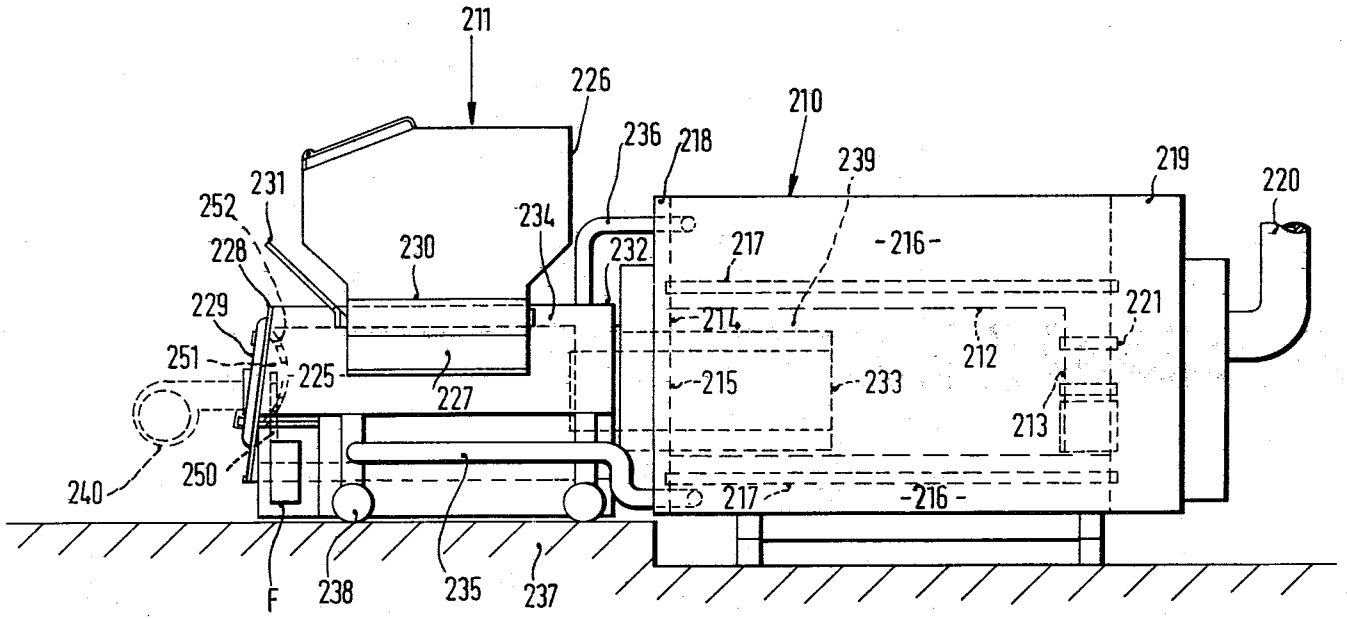
FIGS. 3 and 4 are similar views to FIGS. 1 and 2 of an alternative furnace which embodies the invention.

Referring now to FIG. 3, there is shown a combination of a boiler 210 and an auxiliary solid-fuel fired furnace 211, herein referred to as the furnace.

The boiler 210 comprises a combustion tube 212 having a closed end 213, the other end 214 thereof having an opening 215. The boiler 210 is designed for oil and/or gas firing and is of overall smaller dimensions than would be a solid fuel fired boiler of the same rated output. In the boiler 210 shown, a door which closed the opening 215 having an oil and/or gas burner mounted therein, has been removed.

The boiler 210 is of elongate substantially cylindrical configuration, the combustion tube 212 being located within a water space 216 through which a pass of smoke tubes 217 extend, in the longitudinal direction thereof, the tubes 217 opening at each end into smoke boxes 218 and 219 and surrounding the combustion tube 212 in a circular configuration.

The smoke box 218 at the end adjacent to and surrounding the opening 215, communicates with the combustion tube 212, and the smoke box 219 at the opposite end communicates with a flue 220.

Thus when the boiler is oil and/or gas fired, the boiler 210 is of the two pass type, the flame and hot gases being projected into the combustion tube 212 by the oil and/or gas burner mounted in the door, reversing direction as they reach the closed end 213 and contacting the wall of the combustion tube 212 thereby providing a first heating pass, and entering the smoke box 218 from where they pass along the smoke tubes 217 which provide the second heating pass to the smoke box 219 to the flue 220, whilst heating the water in the water space 216.

Several small pipes 221 are provided in and extend through the closed end 213 into the smoke box 219 to induce the hot gases and flame to pass along the combustion tube 212 to heat it along the entire length thereof.

Previously, converting a boiler which is specifically designed for oil and/or gas firing to solid fuel firing and achieving the rated output, has proved difficult for the following reasons.

First, a combustion tube of an oil and/or gas fired boiler is generally physically smaller than the equivalent solid fuel fired boiler for a given output as the calorific value of oil or gas is greater than solid fuel, and thus it is not necessary to burn such a great quantity of oil or gas at once.

Secondly, there is not a sufficient space to provide a fire bed in the combustion tube of an oil and/or gas fired boiler. If solid fuel were burnt in the smaller oil and/or gas fired boiler combustion tube, at least some of the combustion tube wall surface will be covered by the fire bed thereby reducing the effective wall area of the combustion tube which the hot gases can heat. Thus the efficiency of the boiler will be reduced and the boiler will not be able to achieve its rated output i.e. the boiler will be de-rated.

Thirdly, in solid fuel fired boilers it is normally necessary for solid fuel to be burnt along substantially the entire length of the combustion tube because, if solid fuel is only burnt at one end e.g. adjacent the door, the flame and hot gases produced would pass directly into the smoke box at that end and from there into the smoke tubes without satisfactorily heating the entire length of the combustion tube or reversing direction at the closed end thereof. Thus it is difficult to direct solid fuel to the closed end of the combustion tube of a boiler designed for oil and/or gas firing, and thus to ensure that the solid fuel is burnt along substantially the entire length thereof.

To overcome these difficulties, an auxiliary furnace 211 is provided which is of the grateless type and comprises a combustion chamber 225 into which solid fuel is fed from a hopper 226 via two channels 227, one either side of the combustion chamber 225, to ensure that fuel is fed to and burnt along the entire length of the chamber 225.

The flow of fuel from the hopper 226 is regulated by gate valves 230 which are controlled manually by a handle 231 or automatically by solenoids activated by pressure or temperature thermostats of the furnace 211 and/or the boiler 210, provided in an electronic control circuit programmed to provide a predetermined boiler output, for a predetermined time.

The fuel falls to the bottom of the chamber 225 where, when combusted, it forms a fire bed. Air is passed into the combustion chamber 225, in the same manner as described in FIGS. 1 and 2, from a duct to which air is fed from a fan F. The duct has a dividing wall therein whereby the air from the fan F is divided into primary and secondary supplies, the primary supply passing to any inlet and thus into a reservoir, and the secondary supply is passed into a further duct 250.

Dampers (not shown) are provided in the duct to regulate the primary and secondary supplies, and lining the upper part of the furnace with refractory material instead of the water jacket surrounding substantially the entire furnace.

Air passes from the reservoir upwardly through tubes and thus into the fire bed on the bottom of the combustion chamber 225 which will have primary air, passed therethrough to assist in combustion and to maintain the entire fire bed at a high temperature.

The duct 250 extends to a hollow 251 in the slag door 229 wherein the secondary air passes into the slag door 229 for heating. The slag door 229 has apertures 252 therein whereby the secondary air supply passes into the combustion chamber above the level of the fire bed to further enhance combustion. It will be appreciated that as the secondary air supply is heated in the hollow door the efficiency of the furnace is increased.

The secondary air supply will provide the furnace with a negative flame characteristic whereas solid fuel fired furnaces normally have a positive flame characteristic.

Slag, clinker and other non-combustibles may be removed from the furnace 211 via the slag door 229 at the forward end 228 of the combustion chamber 225.

At the other end 232 i.e. the rear end of the combustion chamber 225, there is an opening, an extension nozzle 233 extending therefrom which, in use, is inserted into the combustion tube 212 of the boiler 210 to permit the flame and hot gases from the furnace 211 to pass into the boiler 210.

Substantially the entire combustion chamber 225 is water cooled, the combustion chamber 224 being enveloped in a water jacket 234 having an inlet 235 and an outlet 236, the inlet and outlet being interconnected with the water space 216 by pipework to provide a single water circulating system of the boiler and the furnace to improve the efficiency of the boiler. The extension nozzle 233 is also water cooled, the water being connected with that of the jacket 234.

The pipework is provided with quick release couplings to facilitate removal of the furnace 211 from the boiler 210 for maintenance purposes.

In the example shown, the level of the floor 237 beneath the furnace has been built up so that the nozzle 233 of the furnace is at the correct height for insertion into the opening 215 of the combustion tube 212, and the furnace 211 is mounted on wheels 238 to further facilitate removal. This may not be necessary with all furnaces.

It can be seen that the extension nozzle 233 is of substantially the same length as the combustion chamber 225, which is itself substantially half the length of the combustion tube. Thus the extension nozzle 233 extends substantially halfway into the combustion tube 212. Flame and hot gases from the furnace 211 will pass through the nozzle 233 into the boiler 210 and pass to the closed end 213 of the tube 212, reverse direction and pass back over the water cooled nozzle 233 through space 239 between the external wall of the nozzle 233 and the internal wall of the tube 212, into the smoke box 218.

Thus the two pass boiler shown will be converted to a three pass boiler when solid fuel fired by the nozzle 233, the extra pass being provided by virtue of the fact of the inter-connection of the water cooling system of the furnace and the water space of the boiler, the extension nozzle 233 being cooled by water of the water cooling system of the furnace.

In general it will be appreciated that where a boiler has more than one pass of smoke tubes, i.e. if the boiler is of the X pass type when oil and/or gas fired, that the boiler will be of the (X+1) pass type when solid fuel fired.

A fan may be provided in addition to fan F between the combustion tube 212 of the boiler 210 and the flue, 20 to increase the draught induced.

If desired, an oil and/or gas burner 240 may be mounted on the door 229 of the furnace 211 as shown in dotted lines, so that the boiler 210 can be conventionally oil or gas fired if desired, and/or to provide a quick start up of the furnace 211.

Although the nozzle 233 has been described as extending half way into the combustion tube 212 of the boiler, if required the dimensions of the boiler and furnace may be different in which case the nozzle will extend into the tube 212 a different amount. As a minimum, the nozzle 233 will need to extend at least a distance equal to the thickness of the wall of the furnace 211, but the nozzle 233 may be of any length provided that there is space adjacent the closed end of the tube 212 in which the hot gases can change direction.

Thus the oil or gas boiler can be solid-fuel fired and operated at its rated output. It has been found that the furnace/boiler combination described has an output up to 20% higher than the rated output of the boiler 210 when conventionally oil or gas fired.

The furnace of the furnace/boiler combination shown in FIG. 3 may be suitably modified to embody the present invention, by providing an opening in the bottom of the combustion chamber 225 of the furnace.

Figure 4:
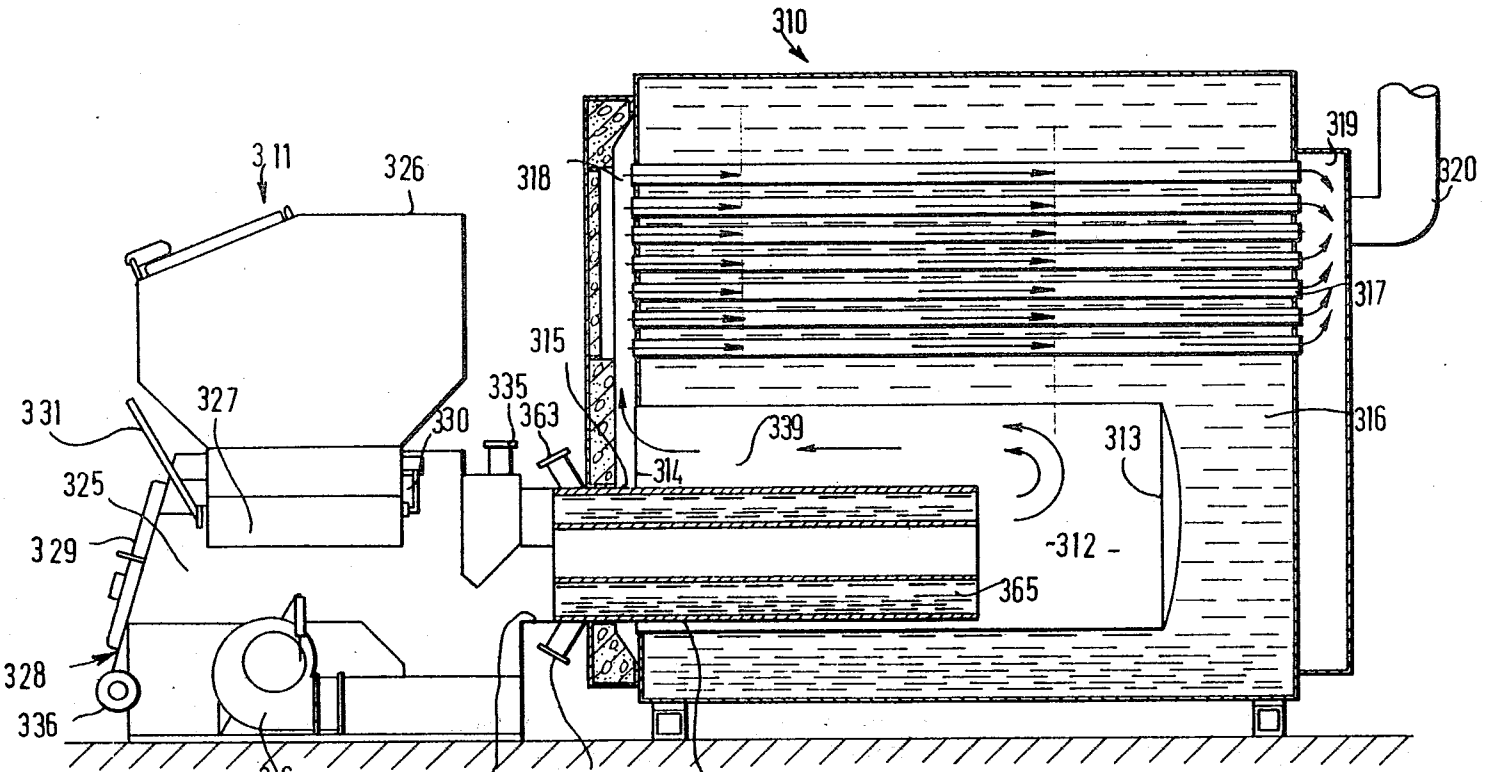

Referring now to FIG. 4 of the drawings, there is shown an alternative boiler 310 and an auxiliary solid-fuel fired furnace 311 combination which may be modified to embody the invention.

The boiler 310 comprises a combustion tube 312 having a closed end 313, the other end 314 thereof having an opening 315. Like the boiler 210 of FIG. 3, the boiler 310 is designed for oil and/or gas firing and is of smaller overall smaller dimensions than would be a solid fuel fired boiler of the same rated output.

The boiler 310 is also of elongate substantially cylindrical configuration, the combustion tube 312 being located within a water space 316 of the boiler through which a pass of smoke tubes 317 extend, in the longitudinal direction thereof, the tubes 317 opening at each end into smoke boxes 318 and 319. The smoke tubes 317 do not surround the tube 312 as do the tubes 217 of the boiler 210 of FIG. 3, but are in an overhead arrangement. The water space 316 has inlet and outlet flow connectors (not shown).

The smoke box 318 at the end adjacent to and surrounding the opening 315, communicates with the combustion tube 312, and the smoke box 319 at the opposite end communicates with a flue 320.

The auxiliary furnace 311 is of the grateless type and comprises a combustion chamber 325 into which solid fuel is fed from a hopper 326 via two channels 327, one either side of the combustion chamber 325 to ensure that fuel is fed to and burnt along the entire length of the chamber 325.

The flow of fuel from the hopper 326 is regulated by gate valves 330 which are controlled manually by a handle 331 or automatically by solenoids activated by pressure or temperature thermostats of the furnace 311 and/or the boiler 310.

The fuel falls to the bottom of the chamber 325 where, when combusted, it forms a fire bed. Air is passed upwardly into the combustion chamber 325 through tubes welded in apertures in the bottom of the chamber 325 from a duct to which air is fed from a fan 3G' and a secondary supply is passed into the combustion chamber 325 from a further duct (not shown) above the level of the fire bed.

Slag, clinker and other non-combustibles may be removed from the furnace 311 via a slag door 329 at the forward end 328 of the combustion chamber 325.

At the rear end 332 of the combustion chamber 325, there is an opening, an extension nozzle 333 extending therefrom which, in use, is inserted into the combustion tube 312 of the boiler 310 to permit the flame and hot gases from the combustion chamber 325 of the furnace 311 to pass into the combustion tube 312 of the boiler 310.

Substantially the entire combustion chamber 325 is water cooled, the combustion chamber 325 being enveloped in a water jacket having an inlet 335 and an outlet 336. The extension nozzle 333 is also water cooled, the water jacket 365 thereof having inlet 363 and outlet 364 flow connectors.

In the example shown in FIG. 4, the level of the nozzle 333 is arranged so that the nozzle 333 of the furnace 311 is at the correct height for insertion into the opening 315 of the combustion tube 312.

The nozzle 333 is separable from the remainder of the furnace 311 unlike the nozzle 233 of the furnace 211 of FIG. 3. This is facilitated because the water jacket of the furnace 111, and the water jacket 365 of the nozzle 333, are not interconnected. Further, the jackets are independent of of the water space 316 of the boiler 310 hence facilitating removal of the furnace 311 from the boiler for maintenance.

The hot water from the jacket of the furnace 311, the jacket 365 of the nozzle 333, and the water space 316 of the boiler 310 are all fed in parallel to be used for heating or as desired.

It can be seen that the extension nozzle 333 in this example is of slightly greater length than the combustion chamber 325, of the furnace 311. Thus the extension nozzle 333 extends slightly more than halfway into the combustion tube 312. Flame and hot gases from the furnace 311 will pass through the water cooled nozzle 333 to provide a first heating pass into the boiler 310 and pass to the closed end 313 of the tube 312, thereby to provide a seond heating pass, reverse direction and pass back over the water cooled nozzle 333 through space 339 between the external wall of the nozzle 333 and the internal wall of the tube 312, into the smoke box 318 and hence through smoke tubes 317 to the flue 320 to provide a third heating pass.

Thus this two pass boiler will also be converted to a three pass boiler when solid fuel fired by the furnace 311 by virtue of the nozzle 333, the extra pass being provided by virtue of the fact that hot water from the nozzle 333 and furnace is utilised along with hot water from the water space 316 of the boiler 310.

Because the nozzle 333 is being heated both from within and by the hot gases in space 339, a pump may be necessary to increase the water flow and hence cooling capability of the jacket 365.

Various modifications may be made to the combinations of FIG. 3 or FIG. 4. For example, instead of providing a nozzle 233 or 333 in the form of a cylinder surrounded by a water jacket, the nozzle 233, 333 may comprise a plurality of smoke tubes enveloped in a water jacket. The nozzle 233, 333 need not be cylindrical, but may be triangular, elliptical, hexagonal or other polygonial in section.

Further, where it is not desired or necessary to increase the number of passes of the boiler, for example where de-rating of the boiler is not detrimental, the nozzle may be provided without a water jacket but be refractory lined.

Different lengths of nozzles 233, 333 may be used if desired but as a minimum, the nozzle 233, 333 will need to extend at least a distance equal to the thickness of the wall of the furnace 211, 311 so that the flame and hot gases can be transferred from the furnace 311 into the combustion chamber 312 of the boiler 310. However, the nozzle 233, 333 may be of any greater length provided that there is space adjacent the closed end of the tube 212, 312 in which the hot gases can change direction.

Thus an oil or gas fired boiler can be solid-fuel fired and operated at its rated output. It has been found that the furnace/boiler combinations described have an output up to 20% higher than the rated output of the boiler 210, 310 when conventionally oil or gas fired.

I claim:

1. A furnace comprising an elongate substantially cylindrical combustion chamber having an unobstructed internal configuration, a central axis disposed horizontally, said combustion chamber comprising a furnace roof preventing passage of products of combustion therethrough, a furnace bottom, said bottom having two inclined parts in a V configuration extending along the length of the combustion chamber and an opening being provided along the apex of the V for the passage of slag out of the combustion chamber, a lower region of the furnace having a wall cooled by a water jacket, an upper region of the furnace having a horizontally extending passage for the egress of products of combustion horizontally out of the combustion chamber, said upper region being lined with a refractory material, channels being provided through said wall of said lower region above said bottom, to permit of passage of solid fuel under gravity through said channels and into said combustion chamber and to permit said fuel to form a quiescent fire bed supported on said inclined parts, nozzles in said inclined parts to direct primary air through said bed to assit in combustion thereof, said nozzles extending through said water jacket, and a hopper above the furnace in which the solid fuel is stored with the fuel resting on a guide to ensure an even flow of fuel from the hopper over the entire length of the combustion chamber, the guide being of inverted V-configuration to permit the fuel to be fed to both sides of the combustion chamber simultaneously, with the fuel fed into the combustion chamber from the hopper through said channels, each of which communicates with the combustion chamber, gates valves being provided to regulate the flow of fuel to the furnace and to shut off the flow of fuel altogether if required.

2. A furnace according to claim 1 wherein the opening extends substantially along the whole length of the combustion chamber.

3. A furnace according to claim 1 wherein a secondary supply of air is supplied to the combustion chamber above the level of the fire bed to enhance combustion in the fire bed.

4. A furnace according to claim 3 wherein the secondary air is preheated by introducing the air into a hollow provided in a part of the wall of the furnace.

5. A furnace according to claim 1 wherein the furnace is a pre-burner adapted to be used in conjunction with a boiler which itself has a combustion chamber.

6. A furnace according to claim 5 wherein the combustion chamber of the furnace has said exhaust opening at one end thereof through which the flame and hot gases pass into the boiler and the exhaust opening is provided with a nozzle to enhance the transfer of hot gases and burning fuel.

* * * * *